US010972849B2

(12) United States Patent
Lee et al.

(10) Patent No.: US 10,972,849 B2
(45) Date of Patent: Apr. 6, 2021

(54) ELECTRONIC APPARATUS, CONTROL METHOD THEREOF AND COMPUTER PROGRAM PRODUCT USING THE SAME

(71) Applicant: SAMSUNG ELECTRONICS CO., LTD., Suwon-si (KR)

(72) Inventors: Yoon-jae Lee, Seoul (KR); Woo-jung Lee, Hwaseong-si (KR); Young-suk Song, Suwon-si (KR); Hae-kwang Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 175 days.

(21) Appl. No.: 16/032,472

(22) Filed: Jul. 11, 2018

(65) Prior Publication Data

US 2019/0052986 A1 Feb. 14, 2019

(30) Foreign Application Priority Data

Aug. 11, 2017 (KR) ..... 10-2017-0102473

(51) Int. Cl.
*H04S 1/00* (2006.01)
*H04S 5/00* (2006.01)
(Continued)

(52) U.S. Cl.
CPC ..... *H04S 1/002* (2013.01); *H04H 20/89* (2013.01); *H04S 5/005* (2013.01); *H04S 7/307* (2013.01); *G10L 19/008* (2013.01)

(58) Field of Classification Search
CPC .. H04S 3/008; H04S 2400/01; H04S 2420/01; H04S 2400/11; H04S 5/005;
(Continued)

(56) References Cited

U.S. PATENT DOCUMENTS 8,885,836 B2 11/2014 McGrath et al.
9,391,575 B1 7/2016 Yang
(Continued)

FOREIGN PATENT DOCUMENTS

EP 1 507 441 A1 2/2005
EP 1 814 360 A2 8/2007
(Continued)

OTHER PUBLICATIONS

Search Report and Written Opinion dated Oct. 19, 2018, issued by the International Searching Authority in International Application No. PCT/KR2018/007891 (PCT/ISA/210 and PCT/ISA/237).
(Continued)

*Primary Examiner* — Norman Yu
(74) *Attorney, Agent, or Firm* — Sughrue Mion, PLLC

(57) ABSTRACT

An electronic apparatus includes a memory configured to store instructions; and a processor configured to execute the instructions to: separate an input audio signal into a plurality of channel signals; identify a gain corresponding to a feature difference between a first channel signal, from among the plurality of channel signals, and a second channel signal, from among the plurality of channel signals; and adjust relative ratios among a plurality of output signals according to the identified gain to generate an output audio signal in which a sound image is varied.

16 Claims, 13 Drawing Sheets

(51) Int. Cl.
*H04H 20/89* (2008.01)
*H04S 7/00* (2006.01)
*G10L 19/008* (2013.01)

(58) Field of Classification Search
CPC . H04S 7/30; H04S 7/307; H04S 1/002; H04S 2400/13; H04S 3/002; H04S 7/302; H04S 2420/07; H04S 5/00; H04S 7/303; H04S 2400/07; H04S 2400/05; H04S 3/00; H04S 1/00; H04S 2420/13; H04S 2400/09; H04R 3/04; H04R 5/02; H04R 2430/03; H03G 5/165; H03G 9/025; H04H 20/89; G10L 19/008
USPC ..... 381/2, 10, 12, 17–18, 19, 300, 303, 381/306–307, 310, 27, 58, 59, 71.14, 80, 381/85, 94.1–94.3, 94.7, 98–103, 104, 381/106–107, 120; 704/500
See application file for complete search history.

(56) References Cited

U.S. PATENT DOCUMENTS

2005/0265558 A1* 12/2005 Neoran ..... H04S 1/002 381/17
2007/0110258 A1* 5/2007 Kimijima ..... H04S 7/40 381/97
2008/0187156 A1* 8/2008 Yokota ..... H04R 1/025 381/307
2009/0161879 A1* 6/2009 Yanagawa ..... H04R 5/04 381/17
2010/0054485 A1 3/2010 Moon et al.
2012/0128159 A1 5/2012 McGrath et al.
2015/0213790 A1* 7/2015 Oh ..... G10L 19/008 381/23
2015/0264529 A1 9/2015 Cho
2017/0206909 A1 7/2017 Truman et al.
2017/0208411 A1 7/2017 Seldess et al.

FOREIGN PATENT DOCUMENTS

EP 1814360 * 8/2007
KR 10-2008-0093342 A 10/2008
KR 10-2016-0090869 A 8/2016

OTHER PUBLICATIONS

Communication dated Apr. 8, 2020 issued by the European Intellectual Property Office in counterpart European Application No. 18844891.4.
Carlos Avendano et al., "A Frequency-Domain Approach to Multichannel Upmix", Journal of the Audio Engineering Society, Audio Engineering Society, vol. 52, No. 7/8, Jul. 1, 2004, pp. 740-749, ISSN: 1549-4950, XP001231780.

* cited by examiner

ELECTRONIC APPARATUS, CONTROL METHOD THEREOF AND COMPUTER PROGRAM PRODUCT USING THE SAME

CROSS-REFERENCE TO RELATED APPLICATION

This application is based on and claims priority under 35 U.S.C. § 119 to Korean Patent Application No. 10-2017-0102473, filed on Aug. 11, 2017 in the Korean Intellectual Property Office, the disclosure of which is incorporated herein in its entirety by reference.

BACKGROUND

Field

The disclosure relates to an electronic apparatus and a control method thereof, and more particularly to an electronic apparatus in which a sound image of an audio signal is variable, and a control method thereof.

Description of Related Art

An electronic apparatus, such as a television (TV), a speaker device or the like, which has an audio output function, outputs various audio signals for broadcasting, multimedia contents, etc.

The audio output of the electronic apparatus may be variously implemented, but is often implemented as a stereo speaker or the like for outputting an audio signal. Also, in recent, it is a trend that the electronic apparatus having the audio output function is spread even to miniaturized and unified products.

However, despite such a trend, there is a demand to widely form a sound stage or field with respect to the audio output thereby to listen to a higher quality sound.

By the way, since in general, the sound field expansion is often carried out taking account of a listening space or the like rather than a feature of content itself, a case where a factitious processing only for expanding the sound field regardless of an intension of original sound is carried out may occur.

Accordingly, there is a problem that in the outputted audio signal, a lamprophonia is deteriorated or an inadvertent and distorted sound image fixing may occur.

SUMMARY

Embodiments address at least the above problem and/or other disadvantages and disadvantages not described above.

In accordance with an aspect of the disclosure, there is provided an electronic apparatus including: a signal receiver configured to receive an audio signal; an output interface configured to be output an audio signal; and a processor configured to: separate the received audio signal into a plurality of channel signals; identify a gain corresponding to a feature difference between a first channel signal, from among the plurality of channel signals, and a second channel signal, from among the plurality of channel signals; and control to adjust relative ratios among a plurality of output signals according to the identified gain to change a sound image of the audio signal outputted through the output interface.

The processor may be further configured to adjust a relative ratio between the first channel signal and the second channel signal generated from the separated plurality of channel signals.

The feature difference may include a phase difference between the first channel signal and the second channel signal.

The processor may be further configured to: convert the first channel signal and the second channel signal into frequency domains; and identify a feature difference between the first channel signal and the second channel signal, converted into the frequency domains.

The processor may be further configured to identify the feature difference according to a plurality of frequency sub-bands for the first channel signal and the second channel signal converted into the frequency domains.

The processor may be further configured to identify the feature difference based on low bandpass signals of the first channel signal and the second channel signal.

The feature difference may include a size difference or a time difference between the first channel signal and the second channel signal.

The outputted audio signal may include more channel signals than the audio signal received through the signal receiver.

The processor may be further configured to identify the feature difference according to a plurality of time sections of the received audio signal.

The electronic apparatus may include a display configured to display an image, wherein the received audio signal corresponds to an image content displayed on the display.

In accordance with another aspect of the disclosure, there is provided a control method of an electronic apparatus including: receiving an audio signal; separating the received audio signal into a plurality of channel signals; identifying a gain corresponding to a feature difference between a first channel signal, from among the plurality of channel signals, and a second channel signal, from among the plurality of channel signals; adjusting relative ratios among a plurality of output signals according to the identified gain for generating an audio signal in which a sound image is varied; and outputting the generated audio signal.

The adjusting may include adjusting a relative ratio between the first channel signal and the second channel signal generated from the separated plurality of channel signals.

The feature difference may include a difference between the first channel signal and the second channel signal.

The method may include converting the first channel signal and the second channel signal into frequency domains; and identifying a feature difference between the first channel signal and the second channel signal, converted into the frequency domains.

The identifying the feature difference may include identifying the feature difference according to a plurality of frequency sub-bands for the first channel signal and the second channel signal converted into the frequency domains.

The method may include identifying the feature difference based on low bandpass signals of the first channel signal and the second channel signal.

The feature difference may include a size difference or a time difference between the first channel signal and the second channel signal.

The outputted audio signal may include more channel signals than the received audio signal.

The method may include identifying the feature difference according to a plurality of time sections of the received audio signal.

In accordance with another aspect of the disclosure, there is provided a non-transitory computer readable recording medium having stored thereon a program which, when executed, causes an electronic apparatus to perform a method including: separating an input audio signal into a plurality of channel signals; identifying a gain corresponding to a feature difference between a first channel signal, from among the plurality of channel signals, and a second channel signal, from among the plurality of channel signals; and adjusting relative ratios among a plurality of output signals according to the identified gain for generating an output audio signal in which a sound image is varied.

BRIEF DESCRIPTION OF THE DRAWINGS

The above and other aspects, features, and advantages of embodiments of the disclosure will be more apparent from the following description taken in conjunction with the accompanying drawings, in which.

DETAILED DESCRIPTION OF EMBODIMENTS

Figure 1:
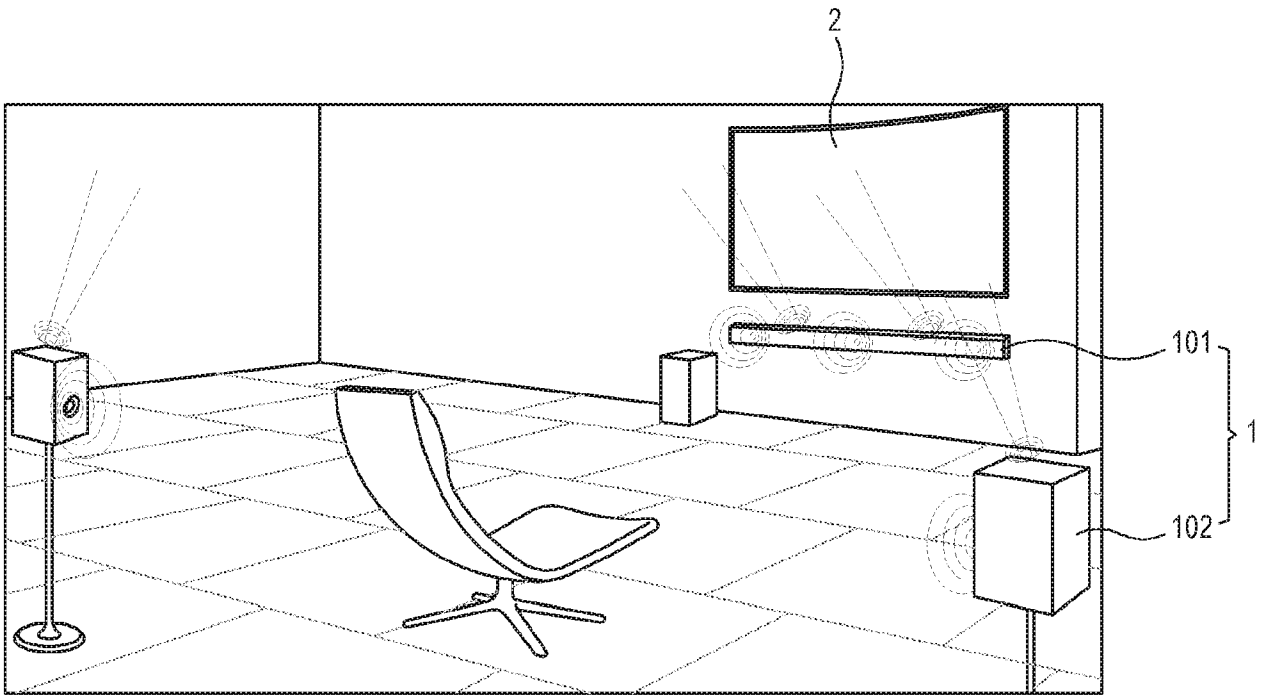
FIG. 1 illustrates an electronic apparatus according to an embodiment.

Hereinafter, embodiments will be described in detail with reference to accompanying drawings. Elements illustrated in the accompanying drawings are referred to in the following descriptions of the embodiments and for clarity, like reference numerals or symbols presented in respective drawings denote like elements, which substantially perform the same functions.

According to embodiments, an electronic apparatus, which can output an audio signal in which a sound image is actively changed according to a feature of content itself without distorting an original sound, a control method thereof, and a computer program product using the same.

Embodiments may provide an electronic apparatus, which can properly control a varying time point of a sound image, thereby reducing an apparatus's load owing to operation quantity and allowing a listener not to feel inconvenience in listening to audio, a control method thereof, and a computer program product using the same.

According to embodiments, the electronic apparatus, the control method thereof and the computer program product using the same may adjust the varying cycle or period of the sound image, thereby allowing the listener not to feel inconvenience in listening to audio due to too frequent changes for the sound image while preventing the apparatus's load owing to the operation quantity from generating.

FIG. 1 illustrates an electronic apparatus 1 according to an embodiment.

The electronic apparatus 1 according to an embodiment provides an audio content for a user. The electronic apparatus 1 may be implemented as one or more speaker devices 101 or 102 which can output an audio signal.

As illustrated in FIG. 1, the electronic apparatus 1 according to an embodiment includes a sound bar type speaker device 101. The electronic apparatus 1 implemented as the speaker device may receive an audio content from an external signal supplying source 2 (for example, a television (TV), an audio/video (A/V) receiver, etc.) via a signal receiver (110 in FIG. 3) and process the received audio content to generate and output an audio signal.

FIG. 1 illustrates by way of an example, an electronic apparatus 1 which can be implemented according to an embodiment, and so the speaker device may be variously implemented in type and/or number. Also, the electronic apparatus 1 is not limited as being connected by wire with the signal supplying source 2 and may receive the audio signal via various types of wired or wireless connections (for example, a Bluetooth connection or the like).

Figure 2:
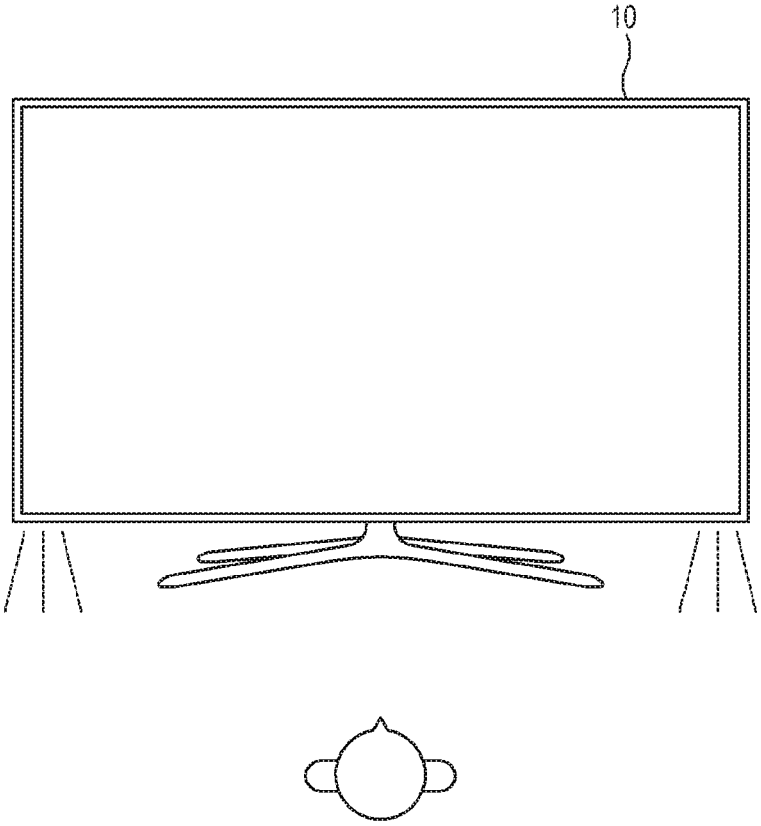
FIG. 2 illustrates an electronic apparatus according to another embodiment.

FIG. 2 illustrates an electronic apparatus 10 according to another embodiment.

As illustrated in FIG. 2, the electronic apparatus according to another embodiment may be implemented as a display apparatus, such as a TV. If the electronic apparatus is implemented as the display apparatus, the electronic apparatus 10 may output an audio signal via a signal output (e.g., output interface)(230 in FIG. 10) provided therein.

Meanwhile, according to other embodiments, the electronic apparatus 10 may be implemented as various electronic apparatuses, such as a laptop personal computer (PC), a tablet PC, a mobile phone, a multimedia player, an electronic frame, a digital advertising board, a large format display (LFD), a set-top box, a DVD player, a BD player, an radio device, an A/V receiver, a headphone, a headset, a mobile audio device, etc., which can output the audio signal.

The electronic apparatuses 1 and 10 according to the embodiments process an input audio signal to generate an output audio signal. The input audio signal may include at least two channel signals (for example, a left channel signal and a right channel signal).

In an embodiment, the electronic apparatuses 1 and 10 may perform an upmix processing which converts the audio signal, so that the channel number M of output audio signal becomes larger than the channel number N of input audio signal. To be more specific, the electronic apparatuses 1 and 10 may be implemented as an apparatus which supports an upmix processing of converting an input audio signal of two channels into an output audio signal of more than two channels (for example, a center channel signal, a left channel signal, a right channel signal, a left surround channel signal and a right surround channel signal).

In an embodiment, the electronic apparatuses 1 and changes, i.e., moves a sound image of an output audio signal in order to vividly reproduce the output audio signal. The sound image refers to a position on which the audio signal outputted from the electronic apparatuses 1 and 10 is virtually focused. In the electronic apparatuses 1 and 10 according to an embodiment, since the sound image of the output audio signal is varied corresponding to a characteristic of content, a sound in which a natural sound stage or field is more expanded may be provided for a listener.

Hereinafter, a more specific configuration of the electronic apparatus 1 according to an embodiment is described.

Figure 3:
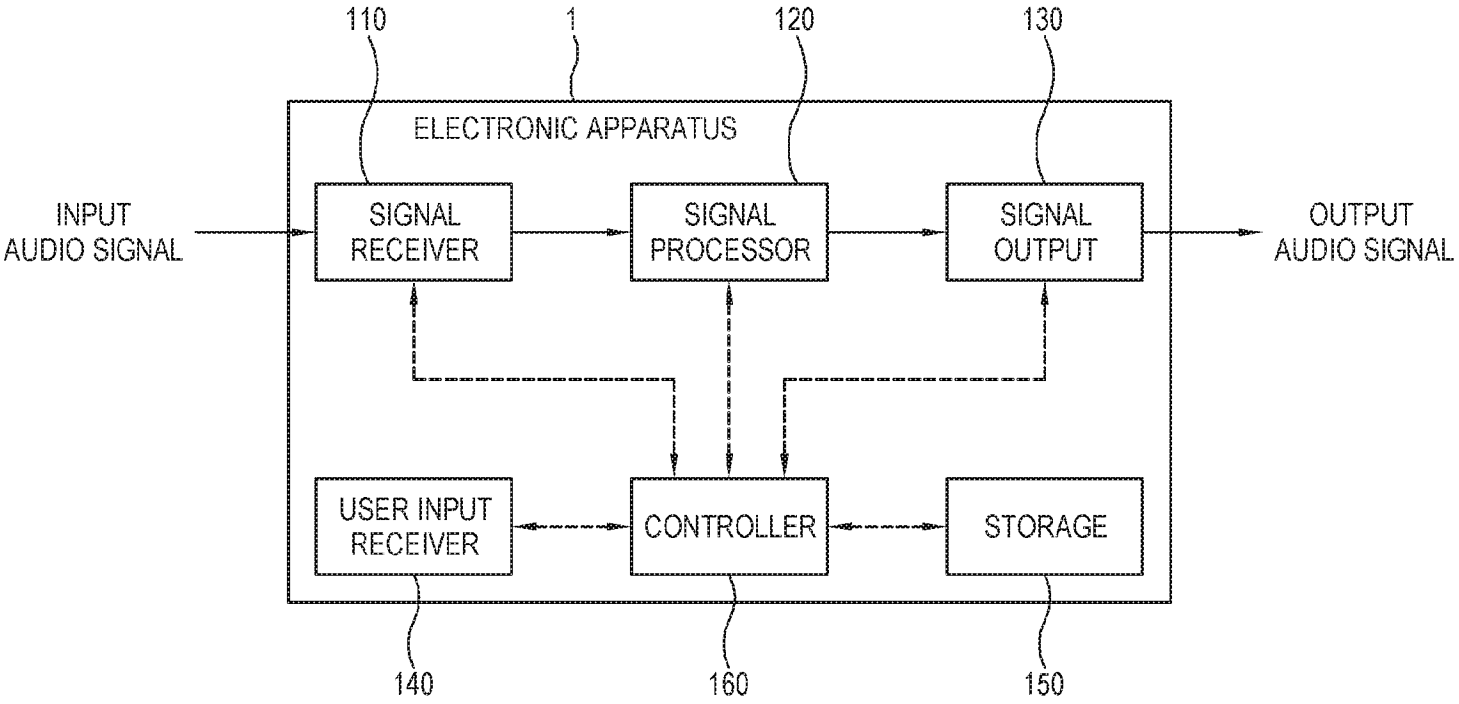
FIG. 3 is a block diagram illustrating a configuration of an electronic apparatus according to an embodiment.

FIG. 3 is a block diagram illustrating a configuration of the electronic apparatus 1 according to an embodiment.

As illustrated in FIG. 3, the electronic apparatus 1 according to an embodiment includes a signal receiver 110, a signal processor 120, and a signal output 130. The electronic apparatus 1 may further include at least one of a user input receiver 140, a storage 150 or a controller 160. However, the configuration of the electronic apparatus 1 illustrated in FIG. 3 is just given by way of an example, and the display apparatus 1 according to an embodiment may be implemented as configurations other than that illustrated in FIG. 3. In other words, the display apparatus 1 according to an embodiment may be materialized to include another element in addition to the elements illustrated in FIG. 3, or exclude at least one element from the elements illustrated in FIG. 3.

The signal receiver 110 may receive an input audio signal. The input audio signal may be received from various external signal supplying sources including a TV 2. The signal supplying sources may include image processing devices, such as a DVD, a PC and the like, and mobile devices, such as a smart phone, a tablet and the like. The signal receiver 110 may also receive an audio signal from a server via the internet.

The signal receiver 110 may include a communicator which communicates with external apparatuses, such as signal supplying sources, to receive the audio signal. The communicator is implemented with various ways according to the external apparatuses. For example, the communicator may include a connecting part for wired communication. The connecting part may transmit/receive signals/data based on standards, such as high definition multimedia interface (HDMI), HDMI-consumer electronics control (CEC), universal serial bus (USB), component and so on, and include more than at least one connector or terminal corresponding to the standards, respectively. The communicator may communicate by wire with a plurality of servers via wired local area network (LAN).

The communicator may be implemented in various other communication ways besides the connecting part including the connector or terminals for wired connection. For example, the communicator may include a radio frequency (RF) circuit for transmitting and receiving a RF signal to perform wireless communication with the external apparatus and may be configured to perform communication via at least one from among wireless fidelity (Wi-Fi), Bluetooth, Zigbee, ultra-wide band (UWB), wireless USB, and near field communication (NFC).

In an embodiment, the signal receiver 110 receives an input audio signal of two or more channels. In other words, the input audio signal received in the signal receiver 110 may be a stereo signal composed of a left channel signal L and a right channel signal R, or include a multichannel audio signal composed of more than two channel signals.

The signal processor 120 processes the input audio signal inputted via the signal receiver 110 according to a given algorithm to generate an output audio signal.

The signal processor 120 (hereinafter, referred to a 'processor') performs an upmix processing which converts the audio signal, so that the channel number M of output audio signal becomes larger than the channel number V of input audio signal. Here, the signal processor 120 is provided to perform an upmix processing by which a natural sound field expansion is made based on psychoacoustics.

The channel number of the output audio signal may be the number of physical speakers or virtual speakers.

In an embodiment, the signal processor 120 may process an input audio signal of two channels composed of a left channel signal L and a right channel signal R to convert into an output audio signal of five channels composed of a center channel signal C, a left channel signal L, a right channel signal R, a left surround channel signal Ls and a right surround channel signal Rs.

In another embodiment, the signal processor 120 may process an input audio signal of two channels composed of a left channel signal L and a right channel signal R to convert into an output audio signal of five channels composed of a center channel signal C, a left channel signal L, a right channel signal R, a left height channel signal Top L and a right height channel signal Top R.

In another embodiment, the signal processor 120 may process an input audio signal composed of the number of channels different from 2, for example, 3, 5 or more channels to convert into an output audio signal composed of different number of channels, for example, 3, 7, 9 or more channels.

The signal processor 120 may generate a directivity output signal which provides a sense of one or more auditory components having a position and/or a direction for the listener.

To be more specific, the signal processor 120 generates an output audio signal according to a given algorithm, and when the generated output audio signal is reproduced via respective speakers constituting the signal output 130, a sound image, i.e., a phantom image is generated at given position(s) between two speakers.

In an embodiment, the signal processor 120 generates the output audio signal, so that the sound image is actively changed, i.e., moved according to a feature of the input audio signal. Detailed configuration and operation of the signal processor 120 will be described later.

In an embodiment, the signal processor 120 may be implemented as a form included in a main system-on-chip (SoC) mounted on a printed circuit board (PCB) built in the electronic apparatus 1. The SoC may include at least one microprocessor or central processing unit (CPU) which is an example of implementing the controller 160 to be describe later.

The output audio signal generated by the signal processor 120 is outputted via the signal output 130 (e.g., output interface) to provide an acoustic content for a user.

The signal output 130 is provided to output an audio of, for example, 20 Hz to 20 KHz band, which is an audible frequency band. The signal output 130 may be installed at various positions taking account of processible audio channels (including virtual channels) and output frequencies. The signal output 130 may include at least one of a sub-woofer, a mid-woofer, a mid-range speaker or a tweeter speaker according to a frequency band of the outputted audio signal.

In an embodiment, the signal output 130 may be implemented as a five channel surround speaker including a center speaker C, a left speaker L, a right speaker R, a left surround speaker Ls, and a right surround speaker Rs.

In another embodiment, the signal output 130 may be implemented as a five channel top speaker including a center speaker C, a left speaker L, a right speaker R, a left height speaker Top L, and a right height speaker Top R.

The user input receiver 140 receives a user input to transmit to the controller 160. The user input receiver 140 may be implemented in various types according to user's input ways. For example, the user input receiver 140 may be implemented as a menu button installed on an outer side of the electronic apparatus 1, an input device capable of receiving a user's command and including a remote controller, a communication interface configured to receive a user's command from an external apparatus having an input device, a microphone configured to recognize a user's voice input, etc.

In an embodiment, the user input receiver 140 may receive a user's command which selects any one of options for sound image change of the signal processor 120 to be described later.

The storage 150 is configured to store various data of the electronic apparatus 1. The storage 150 may be provided with a non-volatile memory (writable ROM) which retains data regardless of whether the electronic apparatus 1 is turned on or off and which is writable to reflect changes. In other words, the storage 150 may be provided with any one of a flash memory, an EPROM and an EEPROM. The storage 150 may be further provided with a volatile memory, such as a DRAM or a SRAM, which has a reading or writing speed faster than the non-volatile memory.

The controller 160 performs controls needed for operating all the elements of the electronic apparatus 1. The controller 160 may include control programs (e.g., one or more instructions) which control to perform the control operations, a non-volatile memory in which the control programs are installed, a volatile memory in which at least one of the control programs is loaded, and at least one microprocessor or central processing unit (CPU) which executes the loaded control program.

The control programs may include a program (or programs) which is implemented in the form of at least one of a BIOS, a device driver, an operating system, a firmware, a platform, and an application program (application). As an embodiment, the application programs may be installed or stored in advance in the electronic apparatus 1 in manufacturing, or installed in the electronic apparatus 1 based data for the application received from an external in use. The data for the application programs may be downloaded to the electronic apparatus 1 from an external server, such as, for example, an application market or the like. The external server is an example of a computer program product according to an embodiment, but is not limited thereto.

As an embodiment, the controller 160 control the signal processor 120 to generate an output audio signal in which a sound image is actively changed based on an input audio signal.

Hereinafter, detailed configuration and function of the signal processor 120 according to an embodiment will be described.

Figure 4:
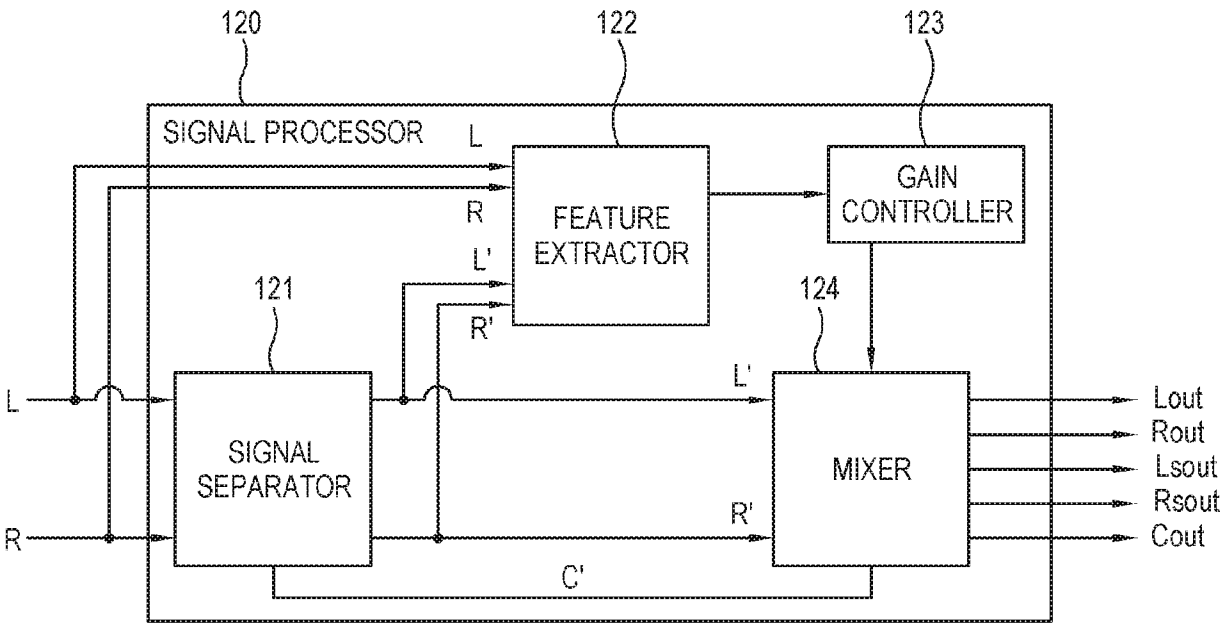
FIG. 4 is a block diagram illustrating a configuration of a signal processor in the electronic apparatus according to an embodiment.

FIG. 4 is a block diagram illustrating a configuration of the signal processor 120 in the electronic apparatus 1 according to an embodiment.

FIG. 4 illustrates by way of an example, a signal processor 120, which performs an upmix process for 2 channel input and 5 channel output. As illustrated in FIG. 4, an audio signal inputted to the signal processor 120 from the signal receiver 110 may include a left channel signal L and a right channel signal R. The signal processor 120 may generate from the received audio signal, a plurality of channel signals, for example, a center channel signal C', a left channel signal L', a right channel signal R', a left stereo channel signal L' and a right stereo channel signal R', and outputs the generated channel signals.

As illustrated in FIG. 4, the signal processor 120 includes a signal separator 121, a feature extractor 122, a gain controller 123, and a mixer 124. Here, respective elements 121 to 124 in the signal processor 120 illustrated in FIG. 4 may not be physical elements, but may be, for example, software modules or logics, which are divided according to their execution functions, respectively.

In other words, in an embodiment, the signal processor 120 may be implemented as a single chip and implemented to perform functions of the signal separator 121, the feature extractor 122, the gain controller 123, and the mixer 124 with a software for operating the single chip. Also, it will be understood by those who in the art that each of the elements in the signal processor 120 may be incorporated therein or removed therefrom according to the performance of the electronic apparatus 100.

The signal processor 120 separates a plurality of channel signals from the inputted audio signal.

In an embodiment, the signal separator 121 may separate and output a center channel signal C', a left channel signal L' and a right channel signal R' (front L'/R'/C') from an input audio signal composed of a left channel signal L and a right channel signal R.

In an embodiment, the signal separator 121 may perform a signal separation using a center signal separation method. In the following descriptions of the embodiments, the left and right channel signals separated from the inputted audio signal by the signal separator 121 are referred to an ambient stereo signal or stereo signal.

The signal separator 121 may calculate a correlation coefficient of the inputted left and right channel signals L and R and separate the center channel signal C' from the inputted left and right channel signals L and R using the calculated correlation coefficient. Here, the signal separator 121 may calculate the correlation coefficient by converting the inputted left and right channel signals L and R into frequency domains. The correlation coefficient is calculated based on a coherence, a similarity and so on between two channel signals. The signal processor 120 controls to bypass the center channel signal C' separated from the inputted audio signal at post-processes.

In an embodiment, the signal separator 121 generates a left stereo channel signal L' using the inputted left channel signal L and the separated center channel signal C', and a right stereo channel signal R' using the inputted right channel signal R and the separated center channel signal C'. The signal separator 121 may generate the left stereo channel signal L' by subtracting a center channel signal C' converted into a time domain from the left channel signal L, and the right stereo channel signal R' by subtracting the center channel signal C' converted into the time domain from the right channel signal R. The left stereo channel signal L' and the right stereo channel signal R' generated as described above are transmitted to the feature extractor 122 for the post-processes.

Although in the drawings and the above-described descriptions, the inputted audio signal has been described as being, for example, a 2 channel signal including the left channel signal L and the right channel signal R, the disclosure is not limited thereto. For example, even if the inputted audio signal is a multichannel audio signal including three channels (for example, a left channel, a right channel and a center channel) or more channels, the disclosure may be applied thereto.

The feature extractor 122 receives the inputted audio signal and the plurality of channel signals separated by the signal separator 121.

In an embodiment, the feature extractor 122 may receive as the inputted audio signal, a left channel signal L and a right channel signal R, and receive from the signal separator 121, a center channel signal C', a left stereo channel signal L' and a right stereo channel signal R'.

The feature extractor 122 identifies a feature difference between a first channel signal and a second channel signal form among the plurality of received channel signals. To be more specific, the feature extractor 122 extracts features from the first channel signal and the second channel signal, respectively, and identifies the feature difference between the first channel signal and the second channel signal using the extracted features.

In the electronic apparatus 1 according to an embodiment, the features extracted from the first channel signal and the second channel signal by the feature extractor 122 correspond to a given property which indicate a content feature of the inputted audio signal itself. To be more specific, the feature difference between the first channel signal and the second channel signal may be, for example, at least one of a phase difference, a size difference or a time difference (time delay) between the first channel signal and the second channel signal. Thus, various features of the audio signal itself may be used in expanding the sound image.

In an embodiment, the feature extractor 122 may identify a feature difference (for example, a phase difference) between a first channel signal and a second channel signal which are converted into frequency regions (frequency domains), respectively. Thus, since a feature of content itself of the received audio signal is used, there is no need to obtain unnecessary additional information.

To this end, the feature extractor 122 may receive the first and second channel signals of time domains, convert the received first and second channel signals into frequency domains using an algorithm, such as a fast Fourier transform (FFT), and identify a feature difference (for example, a phase difference) between the converted first and second channel signals.

As occasion demands, the feature extractor 122 may receive the first and second channel signals of frequency domains and identify a feature difference between the received first and second channel signals.

In another embodiment, the feature extractor 122 may receive the first and second channel signals of time domains and identify a feature difference (for example, a time difference) between the received first and second channel of time domains.

The gain controller 123 identifies a gain corresponding to the feature difference between the first and second channel signals identified by the feature extractor 122. The identified gain is applied to at least one of output signals of the output audio signal. To be more specific, relative ratios among a plurality of output signals constituting the output audio signal are adjusted according to the gain corresponding to the feature difference between the first and second channel signals, so a sound image is varied.

Hereinafter, operations of the feature extractor 122 and the gain controller 123 when the feature difference between the first and second channel signals is a phase difference will be described in detail by way of an example.

Figure 5:
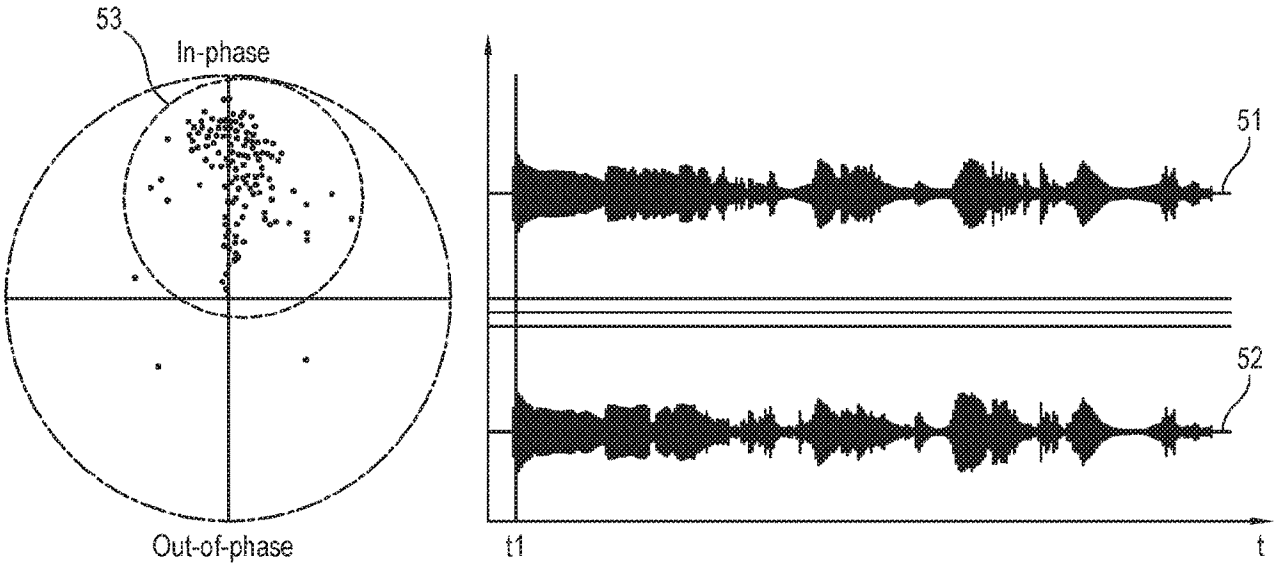
FIGS. 5 and 6 are views for explaining a signal characteristic according to a phase difference between a first channel signal and a second channel signal.
Figure 6:
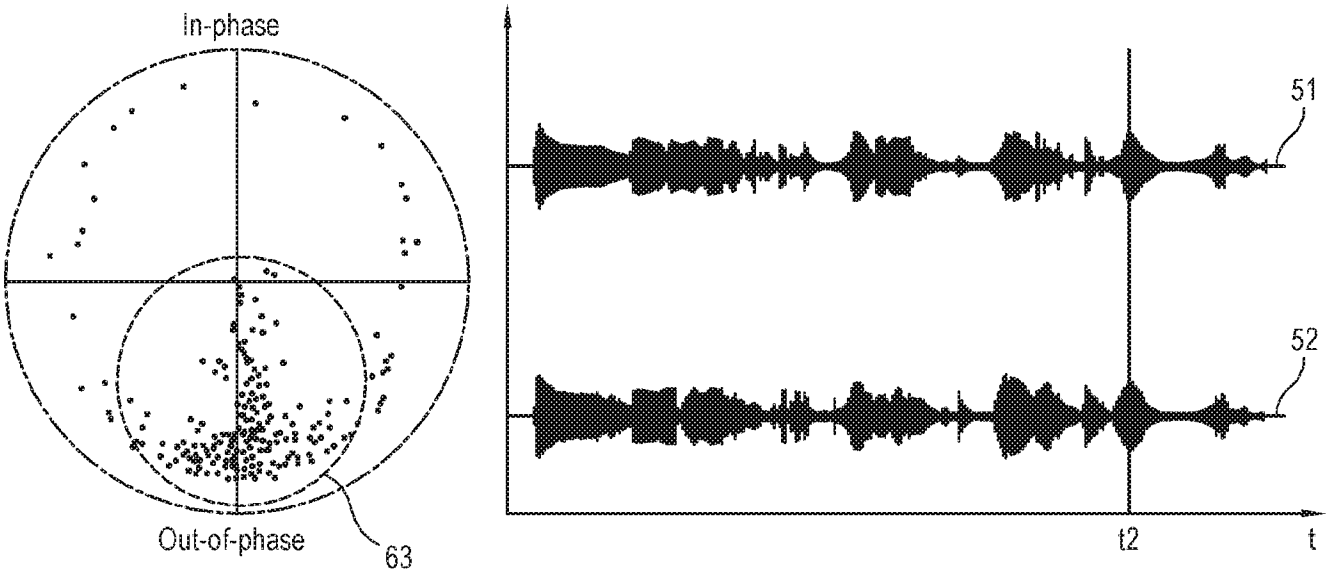
Figure 7:
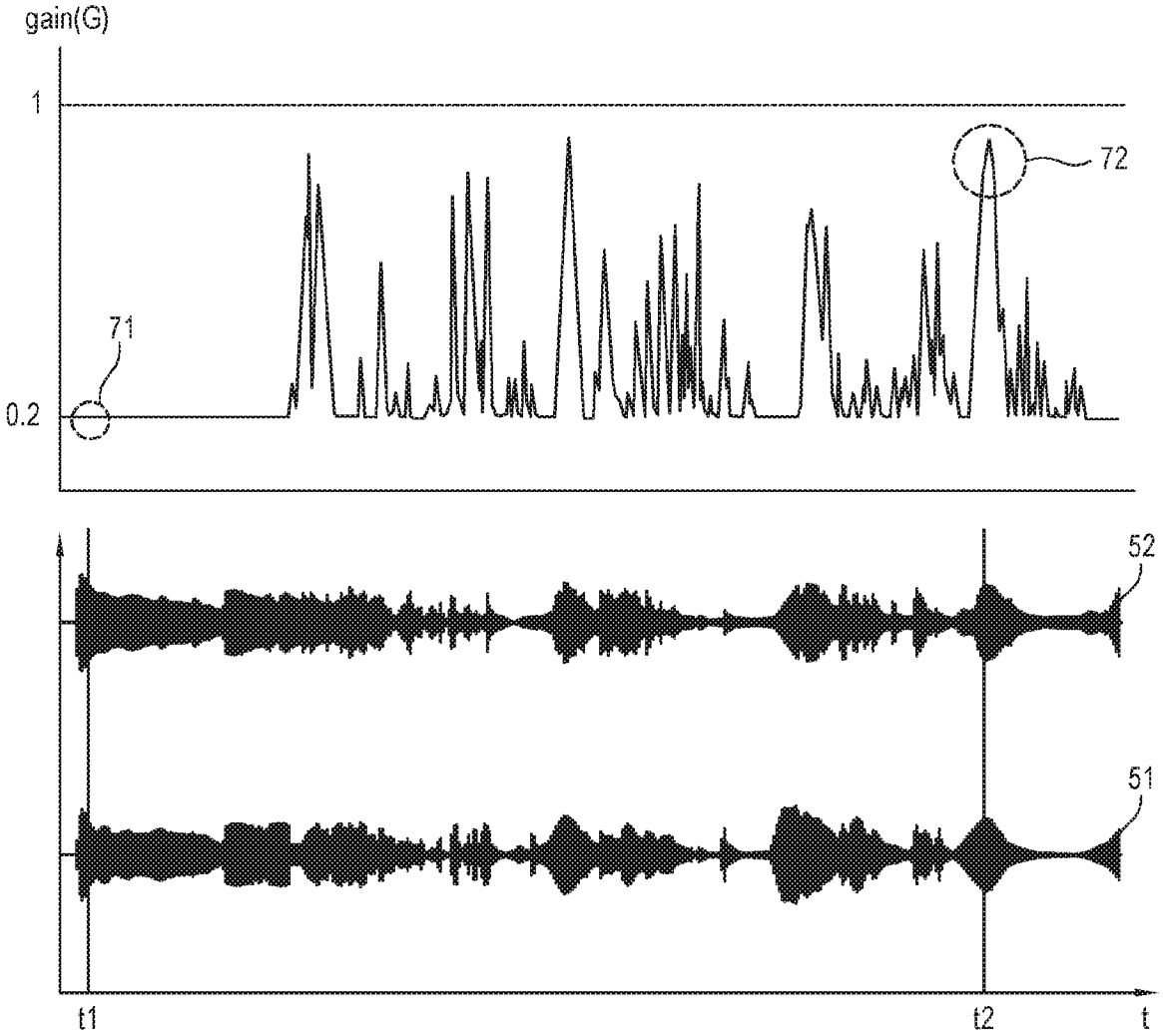
FIG. 7 is a view illustrating a gain identified corresponding to a feature difference.

FIGS. 5 and 6 are views for explaining a signal characteristic according to a phase difference between the first channel signal and the second channel signal, and FIG. 7 is a view illustrating a gain identified corresponding to a feature difference.

In an embodiment, a first channel signal 51 and a second channel signal 52 may be a left channel signal L and a right channel signal R, respectively.

In another embodiment, the first channel signal 51 and the second channel signal 52 may be a left stereo channel signal L' and a right stereo channel signal R', respectively.

In other words, the electronic apparatus 1 according to an embodiment may be configured, so that the signal processor 120 identifies a gain using a feature difference between the channel signals constituting the audio signal inputted via the signal receiver 110 or using a feature difference between the channel signals separated by the signal separator 121.

The feature extractor 122 may identify a feature difference between the first channel signal 51 and the second channel signal 52.

Referring to FIGS. 5 and 6, the feature extractor 122 divides the first channel signal 51 and the second channel signal 52 into a plurality of frequency sub-bands at a given time section, and extracts phases with respect to the divided frequency sub-bands, respectively. The feature extractor 122 may identify difference values, i.e., phase differences, between the extracted phases according to frequency sub-bands.

If extracted phases of the two channel signals are the same, points 53 which correspond to the frequency sub-bands, respectively, are located on an In-phase axis of a left graph, as illustrated in FIG. 5. If a phase difference of the two channel signals is 180 degree (Out of Phase), points 63 which correspond to the frequency sub-bands, respectively, are located on an Out-of-phase axis of a left graph, as illustrated in FIG. 6.

In other words, it may be confirmed that at a time point t1 illustrated in FIG. 5, the phase difference between the two channel signals is relatively small since the points are located around the In-phase axis, and at a time point t2 illustrated in FIG. 6, the phase difference between the two channel signals is relatively large since the points are located around the Out-of-phase axis.

The case where the phase difference of the two channel signals is large, as illustrated in FIG. 6, occurs if the inputted audio signal mainly has a dynamic content characteristic and this may be inferred as following an intention of a phonogram producer (engineer). Accordingly, in an embodiment, the feature difference between the first channel signal and the second channel signal identified by the feature extractor 122 corresponds to a unique characteristic or feature of content itself.

In the electronic apparatus 1 according to an embodiment, the feature extractor 122 is implemented to identify the feature difference according to a plurality of time sections (L numbers of time sections), i.e., frames, with respect to the first channel signal and the second channel signal. Accordingly, the feature difference may be identified to become relatively small at a time section corresponding to the time point t1 and relatively large at a time section corresponding to the time point t2.

Here, the number L of the plurality of time sections may be set taking account of a stability of the output audio signal, an operation quantity of the processor 120, a sound field expansion effect, etc. In other words, if the number L of time sections which are analysis sections for feature difference is large, varying frequency of the gain identified by the gain controller 123 to be described later is increased and operation quantity is increased, thereby increasing a load of the electronic apparatus 1. If the varying frequency of the gain is excessively increased, it may cause the listener to feel inconvenience in listening to music.

To the contrary, if the number L of time sections is small, the varying frequency of the gain is relatively decreased and the operation quantity is also decreased. However, if the varying frequency is excessively decreased, it may be difficult for the listener to feel sound field expansion effect by the variable gain control.

The electronic apparatus 1 according to an embodiment may receive a user's command which selects any one of options for sound image change. The options may be provided to display on a display apparatus 2, for example, a level/frequency of change(s) in sound image with a graphic user interface (GUI), such as 'strong', 'middle', and 'weak', which is selectable by the user. The selection of the options is carried out according to manipulations of the user input receiver 140, such as a remote controller. The feature extractor 122 may identify feature differences between the channel signals according to the number of time sections corresponding to the selected option.

In another embodiment, the signal processor 120 may adjust a size of gain value according to the selected option thereby to control an extent to which the sound image is moved.

The feature extractor 122 calculates K numbers of phase differences according to a plurality of frequency sub-bands with respect to the first channel signal and the second channel signal converted into frequency domains at a given time section, and outputs the calculated phase differences to the gain controller 123.

The gain controller 123 identifies a gain G at the corresponding time section using the K numbers of phase differences calculated according to the plurality of frequency sub-bands (variable gain control).

In an embodiment, the gain controller 123 may identify the gain G by summing up the K numbers of phase differences calculated according to the plurality of frequency sub-bands and normalizing the summed-up phase differences.

The gain D identified by the gain controller 123 has a value of 0 to 1 and varies according to time sections.

In an embodiment, the gain controller 123 may control the gain, so that a minimum gain value comes to 0.2. Like this, if the minimum gain value is set to a value which is not zero, it may prevent the sound from being not outputted at all.

The gain G which is varied according to time sections by the gain controller 123 as described above is identified, so that a value thereof becomes small at a section 71 where the feature difference between the channel signals is small as in the time point t1 and large at a section 72 where the feature difference between the channel signals is large as in the time point t2.

The mixer 124 generates an output audio signal composed of a plurality of channels by applying the gain G identified as described above (surround upmix). The mixer 124 may control to generate an output audio signal in which relative ratios among a plurality of output signals are adjusted according to the identified gain G.

In an embodiment, a relative ratio between a plurality of output signals generated from a first channel signal (a left channel signal L') may be adjusted according to the identified gain G, and a relative ratio between a plurality of output signals generated from a second channel signal (a right channel signal R') may be adjusted according to the identified gain G.

For example, the mixer 124 may generate a left surround speaker signal Ls_out (a first output signal) having a value of Gx by multiplying a left stereo channel signal (the first channel signal L') by a gain value G, and a left speaker signal L_out (a second output signal) having a value of (1−G)x by multiplying the left stereo channel signal L' by a value of 1-G. Also, the mixer 124 may generate a right surround speaker signal Rs_out (a third output signal) having the value of Gx by multiplying a right stereo channel signal (the second channel signal R') by the gain value G, and a right speaker signal R_out (a fourth output signal) having the value of (1−G)x by multiplying the right stereo channel signal R' by the value of 1-G. Accordingly, the larger the gain value G is, the closer the sound image may be moved to the left surround speaker Ls and the right surround speaker Rs.

The mixer 124 further generates a center speaker signal C_out based on a bypassed center channel signal C' from the signal separator 121.

Accordingly, the mixer 124 comes to transmit to the signal output 130, output audio signals L_out, R_out, Ls_out, Rs_out and C_out composed of a plurality of channel signals (for example, 5 channels) based on the received signals.

Although in FIG. 4, the signals outputted via the mixer 124 has been described as being provided for, for example, a 5 channel surround speaker, the disclosure is not limited thereto. In other words, the number of channels of the output audio signal may be variously expanded according to the number of provided speakers.

In the embodiment as described above, the signal processor 120 may generate the output audio signal in which the sound image is actively changed based on the input audio signal, thereby performing the upmix processing by which a natural sound field expansion can accomplished.

Although in the embodiment as described above, the signal processor 120 has been explained as, for example, identifying the feature difference between the channel signals using signals of whole band thereof and performing the gain control according thereto, the disclosure may be also implemented, so that the signal processor 120 identifies a feature difference between the channel signals using signals of some band thereof and performs a gain control according thereto.

In other words, in another embodiment, the signal processor 120 may identify a feature difference between the first and the second channel signals using signals of given band, for example, low bandpass signals, thereof and perform a gain control according thereto. This increases an operation efficiency by using signals of band having a large influence on sound image change.

In the above described another embodiment, the signal processor 120 may further include a low pass filter (LPF) through which passes only low bandpass signals. The low bandpass signals of the channel signals passed through the LPF are transmitted to the feature extractor 122.

The feature extractor 122 identifies, based on low bandpass signals of the left channel signal L and the right channel signal R, a feature difference between the two channel signals. The gain controller 123 identifies a gain value in response to the identified feature difference.

As occasion demands, the feature extractor 122 identifies, based on low bandpass signals of the left stereo channel signal L' and the right stereo channel signal R', a feature difference between the two channel, and the gain controller 123 identifies a gain value in response to the identified feature difference.

In above described another embodiment, methods which identify the feature difference and the gain value according thereto are the same as described with reference to FIGS. 5 to 7.

The mixer 124 generates a plurality of output signals L_out, R_out, Ls_out, Rs_out and C_out based on the gain value identified as described above.

According to the above-described another embodiment, since the feature difference between the channel signals and the gain value according thereto are identified based on the low bandpass signals which mainly affect the sound image change, the operation quantity may be reduced as compared with the previously described embodiment, thereby enabling the electronic apparatus 1 to reduce its own load and to quickly process the audio signal.

Figure 8A:
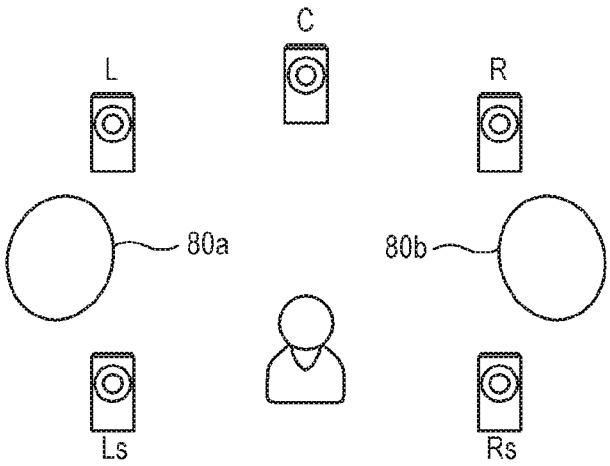
FIGS. 8A to 9B illustrate examples where a sound image of an output audio signal varies according to an embodiment.
Figure 9A:
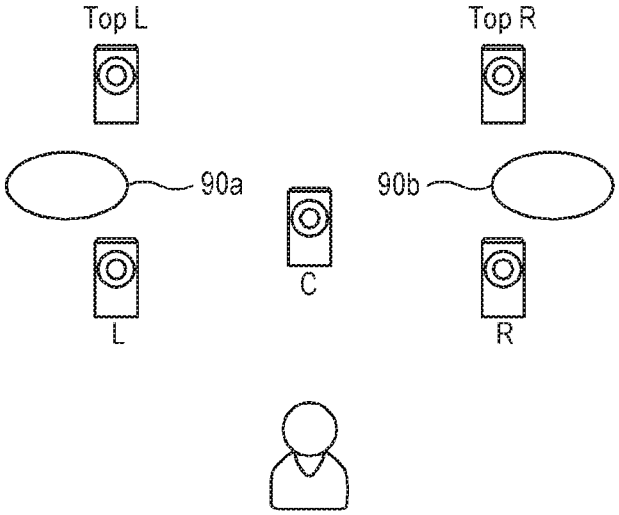
Figure 9B:
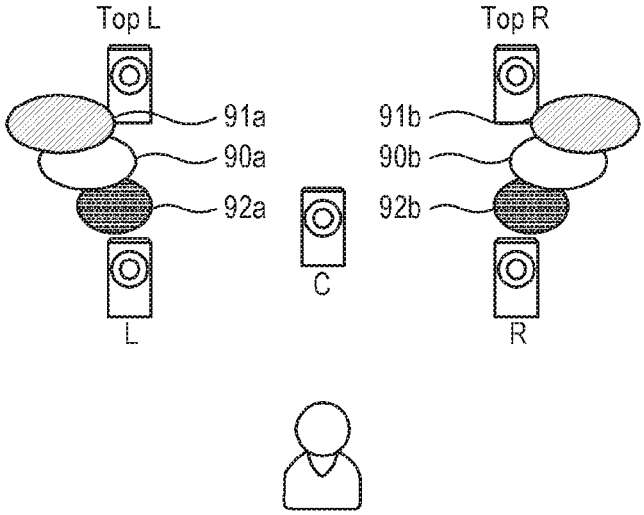

FIGS. 8A and 9B illustrates examples where the sound image of the output audio signal is varied according to an embodiment.

Referring to FIG. 8A, in an existing surround speaker environment which receives a 2 channel audio signal to output a 5 channel audio signal, the sound image is fixed to first positions 80*a* and 80*b*.

Figure 8B:
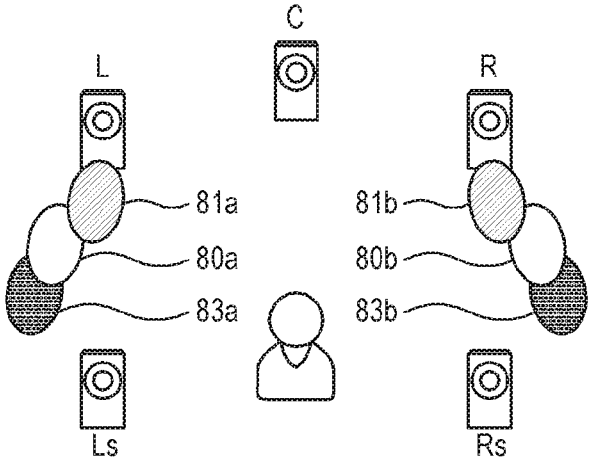

On the other hand, in a surround speaker environment which receives a 2 channel audio signal to output a 5 channel audio signal as in the electronic apparatus 1 according to an embodiment, it may be confirmed that the sound image is not fixed to the first positions 80*a* and 80*b*, but changed to second positions 81*a* and 81*b*, third positions 83*a* and 83*b* or the like according a content characteristic of the audio signal, as illustrated in FIG. 8B. Here, the positions of the sound image are not limited to the positions 80*a*, 80*b*, 81*a*, 81*b*, 83*a* and 83*b* illustrated in FIG. 8B, but may be repeatedly changed to correspond to time sections in which gains are identified, respectively, between the left speaker L and the left surround speaker Ls and between the right speaker R and the right surround speaker Rs.

In the electronic apparatus 1 of the surround speaker environment according to an embodiment as described above, the sound image is actively varied, so that the larger the gain value G identified to correspond to the feature difference between the channel signals is, the more the sound image is moved toward the left surround speaker Ls and the right surround speaker Rs (83*a* and 83*b*) and the smaller the gain value is, the sound image is moved toward the left speaker L and the right speaker R.

Referring to FIG. 9A, in an existing top speaker environment which receives the 2 channel audio signal to output the 5 channel audio signal, the sound image is fixed to first positions 90*a* and 90*b*.

On the other hand, in a top speaker environment which receives the 2 channel audio signal to output the 5 channel audio signal as in the electronic apparatus 1 according to an embodiment, it may be confirmed that the sound image is not fixed to the first positions 90*a* and 90*b*, but changed to second positions 91*a* and 91*b*, third positions 92*a* and 92*b* or the like according a content characteristic of the audio signal, as illustrated in FIG. 9B. Here, the positions of the sound image are not limited to the positions 90*a*, 90*b*, 91*a*, 91*b*, 92*a* and 92*b* illustrated in FIG. 9B, but may be repeatedly changed to correspond to time sections in which gains are identified, respectively, between the left speaker L and the left height speaker Top L and between the right speaker R and the right height speaker Top R.

In the electronic apparatus 1 of the top speaker environment according to the embodiment as described above, the sound image is actively varied, so that the larger the gain value G identified to correspond to the feature difference between the channel signals is, the more the sound image is moved toward the left height speaker Top L and the right top speaker Top R (92*a* and 92*b*), and the smaller the gain value is, the sound image is moved toward the left speaker L and the right speaker R.

On the other hand, the electronic apparatus according to another embodiment may be implemented as a speaker for the display apparatus, such as a TV, as described with reference to FIG. 2.

Figure 10:
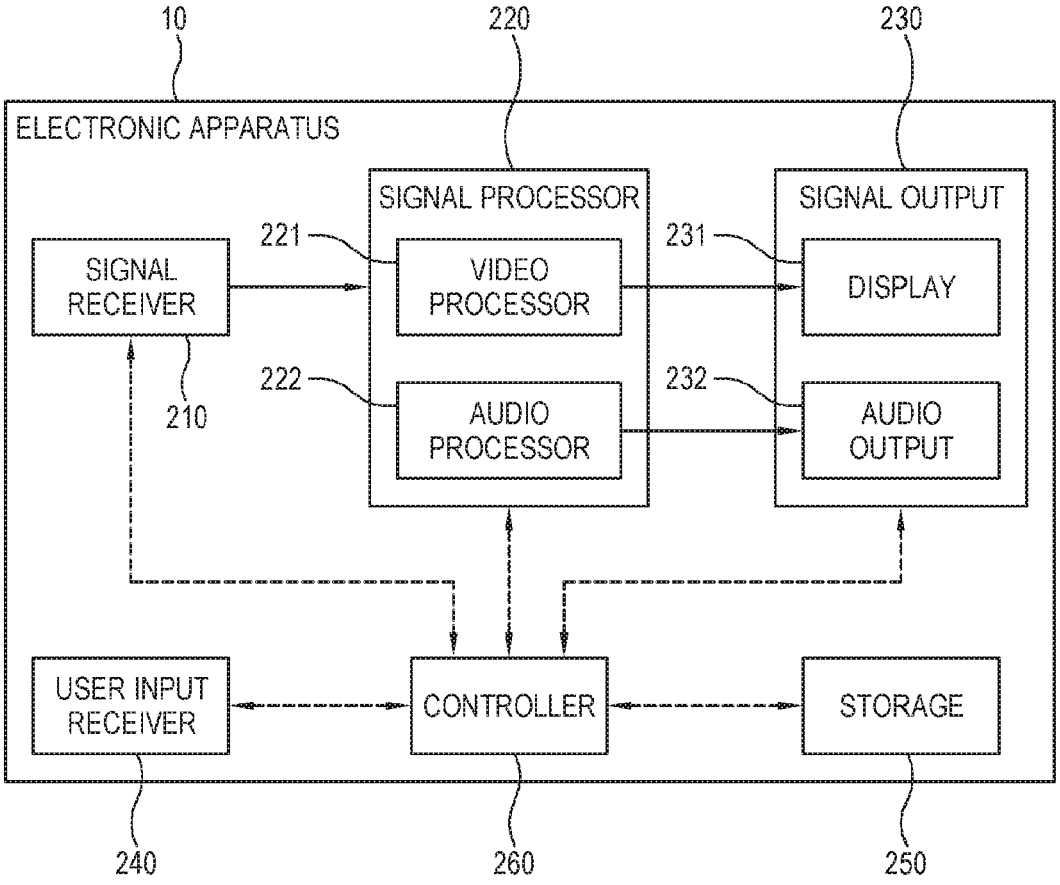
FIG. 10 is a block diagram illustrating a configuration of an electronic apparatus according to another embodiment.

FIG. 10 is a block diagram illustrating a configuration of the electronic apparatus 10 according to another embodiment.

The electronic apparatus 10 according to another embodiment is different in configuration from the electronic apparatus 1 according to an embodiment in that a signal processor 220 further includes a video processor 221 and a signal output 230 further includes a display 231.

Thus, in the electronic apparatus 10 according to another embodiment and the electronic apparatus 1 according to an embodiment, like reference numerals or symbols denote like elements which substantially perform the same functions. Also, to avoid duplicated explanations, detailed descriptions on like elements will be omitted.

The electronic apparatus 10 receives a content signal including a video signal and an audio signal from an external. Kinds of video signals processed in the electronic apparatus 10 are not limited, so the electronic apparatus 10 may receive the content signal from various types of external apparatuses. Also, the electronic apparatus 10 may process signals to display on the display 231, motion images, still images, applications, on-screen displays (OSDs), user interfaces (UIs) (hereinafter, referred to 'graphic UIs') for various operations, etc. based on signals/data stored in storing media of the internal/external.

The content signal received in the electronic apparatus 10 includes a broadcast signal. The broadcast signal may receive via satellite, terrestrial television, cable, and so on. In an embodiment, a signal supplying source is not limited to a broadcast station. In other words, any apparatus or station may be included in the signal supplying source as long as it can transmit and receive information.

In an embodiment, the electronic apparatus 10 may be implemented as a smart TV or an internet protocol (IP) TV. The smart TV is a TV which may receive a broadcast signal in real time and provide a web browsing function, thereby displaying the broadcast signal in real time and at the same time searching for and consuming various contents via the internet, and which may provide convenient user environment for that purposes. Also, the smart TV include an open software platform which can provide a bi-directional service for the user. Accordingly, the smart TV may provide many contents, for example, applications for providing given services, for the user via the open software platform. The applications are application programs which can provide various kinds of services, and includes, for example, applications which provide services, such as social network service (SNS), finance, news, weather information, map information, music, movies, games, electronic books, etc.

As illustrated in FIG. 10, the electronic apparatus includes a signal receiver 210 which receives a content signal including a video signal and an audio signal, a single processor 220 which processes the signal received in the signal receiver 210, a signal output 230 which outputs the signal processed by the signal processor 220, a user input receiver 240 which receives a user input, a storage 250 which stores all sorts of data/information, and a controller 260 which controls operations of all elements in the electronic apparatus 10.

The signal receiver 210 receives a content signal to transmit to the signal processor 220 and may be implemented in various forms according to standards of the received image signal and implemented types of the electronic apparatus 10. For example, the signal receiver 210 may receive a radio frequency (RF) signal transmitted from a broadcasting station by wireless, or a content signal according to standards, such as composite video, component video, super video, SCRAT, high definition multimedia interface (HDMI), etc. by wire.

In an embodiment, if the content signal is a broadcasting signal, the signal receiver 210 may include a tuner which tunes the broadcasting signal according to channels.

Further, the content signal may be received from eternal apparatuses, such as, for example, a mobile device including a smart phone, a smart pad such as a tablet, and a MP3 player, a personal computer (PC) including a desktop or a laptop, etc.

Furthermore, the content signal may come from data received via a network, such as an internet, and in this case, the electronic apparatus 10 may further include a communicator to perform the communication via the network.

Also, the content signal may come from data stored in the storage 250 which is materialized as a nonvolatile memory, such as a flash memory, a hard disk and the like. The storage 250 may be provided inside or outside the electronic apparatus 10. If the storage 250 is provided outside the electronic apparatus 10, the electronic apparatus 10 may further include a connector (not illustrated) to which the storage 250 is connected.

The audio signal received by the signal receiver 210 may be a stereo signal including a left channel signal and a right channel signal, a multichannel audio signal composed of a plurality of channel signals, etc. The audio signal received by the signal receiver 210 corresponds to a video content which is displayed on a display 231 to be described later.

The signal processor 220 (hereinafter, referred to a 'processor') performs various given video/audio processes with respect to the signal received from the signal receiver 210. The signal processor 220 includes a video processor 221 which processes a video signal and an audio processor 222 which processes an audio signal.

The audio processor 222 performs an upmix processing which converts the audio signal, so that the channel number M of output audio signal becomes larger than the channel number N of input audio signal.

Processes in the audio processor 222 correspond to processes in the signal processor 120 which are explained with reference to FIGS. 3 to 9. In other words, the audio processor 222 includes a signal separator 121, a feature extractor 122, a gain controller 123 and a mixer 24, as illustrated in FIG. 4, and separates the audio signal received from the signal receiver 210 into a plurality of channel signals, identifies a feature difference between a first channel signal and a second channel signal (for example, between a left channel signal L and a right channel signal R, or between a left stereo channel signal L' and a right stereo channel signal R'), and identifies a gain corresponding to the identified feature difference. The audio processor 222 adjusts relative ratios among the plurality of channel signals according to the identified gain thereby to change a sound image of an output audio signal. Here, the audio processor 222 may adjust a relative ratio between a first channel signal and a second channel signal generated from the plurality of separated channel signals. Also, the audio processor 222 may further a LPT which extracts low bandpass signals.

The video processor 221 outputs to the display 231, a video signal generated or combined performing a video process with respect to video thereby to display an image corresponding to the video signal on the display 231. The video processor 221 includes a decoder which decodes the video signal to correspond to a video format of the electronic apparatus 10, and a scaler which adjusts the video signal to meet an output standard of the display 231. The decoder according to an embodiment may be implemented as, for example, a moving picture experts group (MPEG) decoder. Here, Kinds of video processing processes performed by the image processor 221 according to an embodiment are not limited. For example, the image processor 221 may further perform at least one of various processes, such as de-interlacing for converting an interlace type image signal into a progressive type image signal, scaling for changing the image signal in definition, noise reduction for enhancing image quality, detail enhancement, frame refresh rate conversion, line scanning, etc.

The signal processor 220 may be implemented as a group of individual elements which can perform the above-described processes on their own, respectively, or a SoC in which various functions are incorporated.

In an embodiment, the single processor 220 may be implemented as a form included in a main SoC mounted on a PCB built in the electronic apparatus 10. The main SoC may include at least one microprocessor or CPU which is an example implementing the controller 260 to be describe later.

The signal output 230 includes a display 231 which displays an image corresponding to the video signal processed in the video processor 221, and an audio output 232 which outputs the audio signal processed in the audio processor 222.

Implemented types of the display 231 are not limited. For example, the display 231 may be implemented in various display ways, such as liquid crystal display (LCD), plasma, light-emitting diode (LED), organic light emitting diodes (OLED), surface-conduction electron-emitter, carbon nanotube, nano-crystal, etc. The display 231 may further include additional elements according to its implemented type.

The audio output 232 corresponds to the signal output 130 in FIG. 3. In other words, the audio output 232 may be implemented as various types of multichannel speakers, such as a 5-channel surround speaker including a center speaker C, a left speaker L, a right speaker R, a left surround speaker Ls, and a right surround speaker Rs, a 5-channel top channel speaker including a center speaker C, a left speaker L, a right speaker R, a left height speaker Top L, and a right height speaker Top R.

The storage 250 stores unlimited data according to control of the controller 260.

The date stored in the storage 250 includes, for example, an operating system (OS) for driving the electronic apparatus 10, and various applications, image data, additional data and so on, which are executable on the OS. To be more specific, the storage 250 may store signals or data which are inputted/outputted corresponding to respective operations of the elements 210, 220, 230 and 240 according to the control of the controller 260. The storage 250 may store GUIs related to control programs for controlling the electronic apparatus 10 and applications provided by a manufacturer or downloaded from the external, images for providing the GUIs, user information, documents, databases, or related data.

The controller 260 performs control needed for operating many elements of the electronic apparatus 10. To be more specific, the controller 260 controls general operations of the electronic apparatus 10 and signal flows between inner elements of the electronic apparatus 10, and performs data processing function. For example, the controller 260 may perform control operations corresponding to progresses of video/audio processing processes that the signal processor 220 processes and commands from the user input receiver 240, such as a remote controller, thereby controlling the whole operation of the electronic apparatus 10.

As an embodiment, the controller 260 controls the audio processor 222 to generate an output audio signal in which a sound image is actively changed based on an input audio signal, thereby varying the sound image to correspond to content feature as illustrated in FIGS. 8A to 9B.

Hereinafter, a control method of the electronic apparatus according to an embodiment will be described with reference the drawing.

Figure 11:
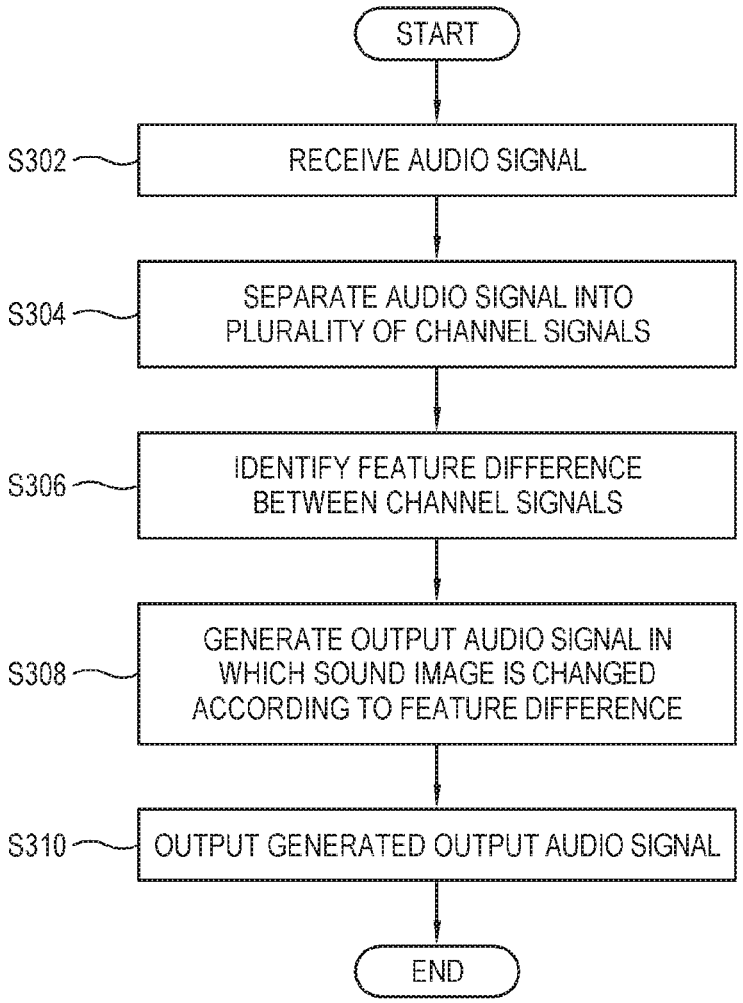
FIG. 11 is a flowchart illustrating a control method of an electronic apparatus according to an embodiment.

FIG. 11 is a flowchart illustrating a control method of the electronic apparatus 1 or 10 according to an embodiment.

As illustrated in FIG. 11, the electronic apparatus 1 or 10 according to an embodiment receives an audio signal (S302). Here, the audio signal may include two or more channel signals (for example, a left channel signal and a right channel signal).

The signal processor 120 or 220 separates the audio signal received at the operation S302 into a plurality of channel signals (S304). The signal processor 120 or 220 may separate, for example, an input audio signal of 2 channels composed of a left channel signal L and a right channel signal R into a center channel signal C', a left stereo channel signal L', and a right stereo channel signal R'.

The signal processor 120 or 220 identifies a feature difference between a first channel signal and a second channel signal (S306). Here, the signal processor 120 or 220 may identify a feature difference between the left channel L and the right channel signal R which is the input audio signal, or a feature difference between the left stereo signal L' and the right stereo signal R' which are separated at the operation S304. The feature difference includes a phase difference between the two channel signals. Thus, the sound image may vary to coincide with an intention of an original sound. The signal processor 120 or 220 may convert the first channel signal and the second channel signal into frequency domains, and identify a feature difference between the first channel signal and the second channel signal converted into the frequency domains. Here, the signal processor 120 or 220 may identify the feature difference according to a plurality of frequency sub-bands of the first channel signal and the second channel signal converted into the frequency domains, or based on low bandpass signals of the first channel signal and the second channel signal. At the operation S306, the signal processor 120 or 220 may identify the feature difference according to a plurality of time sections of the input audio signal.

The signal processor 120 or 220 generates an output audio signal in which a sound image is changed according to the feature difference identified at the operation S306 (S308). Here, the signal processor 120 or 220 may adjust a relative ratio between a plurality of output signals constituting the output audio signal according to a gain corresponding to the feature difference between the first channel signal and the second channel signal, thereby enabling the sound image of the output audio signal to be changed to given positions. Also, as the feature difference is identified according to the plurality of time sections at the operation S306, gain values are applied according to the time sections.

The signal processor 120 or 220 outputs the output audio signal generated at the operation S308 (S310). Here, as the gain values are applied according to the plurality of time sections at the operation S308, the sound image is actively varied, i.e., expanded according to the time sections.

According to the various embodiments as described above, since the sound image of the output audio signal is actively changed according to the phase difference between the channel signals, which is a unique feature in content of the input audio signal, a natural sound field expansion effect may occur without distorting an original sound, thereby increasing listener's satisfaction.

Also, as according to the plurality of time sections, the feature is extracted and the gain values are identified, the varying cycle or period of the sound image may be adjustable, thereby enabling the electronic apparatus to control the audio taking account of even a listener's preference while preventing an apparatus's load owing to operation quantity from generating.

Although the disclosure has been described with various embodiments, various changes and modifications may be suggested to one skilled in the art. It is intended that the disclosure encompasses such changes and modifications as fall within the scope of the appended claims.

What is claimed is:

1. An electronic apparatus comprising:

a signal receiver configured to receive an audio signal;

an output interface configured to be output an audio signal; and a processor configured to:

separate the received audio signal into a plurality of channel signals;

identify a gain corresponding to a phase difference between a left channel signal from among the plurality of channel signals and a right channel signal from among the plurality of channel signals; and control to adjust relative ratios among a plurality of output signals for a plurality of speakers, respectively, which are obtained from the left channel signal and the right channel signal, according to the identified gain to change a sound image of the audio signal outputted through the output interface, wherein the processor is further configured to identify the phase difference between the left channel signal and the right channel signal according to a number of time sections of the received audio signal, and wherein the plurality of output signals comprise:

a first left sub channel signal and a second left sub channel signal which are obtained based on a first gain corresponding to a first phase difference between the left channel signal and the right channel signal, and a first right sub channel signal and a second right sub channel signal which are obtained based on a second gain corresponding to a second phase difference between the left channel signal and the right channel signal.

2. The electronic apparatus according to claim 1, wherein the processor is further configured to adjust a relative ratio between the left channel signal and the right channel signal generated from the separated plurality of channel signals.

3. The electronic apparatus according to claim 1, wherein the processor is further configured to:

convert the left channel signal and the right channel signal into frequency domains; and identify a phase difference between the left channel signal and the right channel signal, converted into the frequency domains.

4. The electronic apparatus according to claim 3, wherein the processor is further configured to identify the phase difference according to a plurality of frequency sub-bands for the left channel signal and the right channel signal converted into the frequency domains.

5. The electronic apparatus according to claim 1, wherein the processor is further configured to identify the phase difference based on low bandpass signals of the left channel signal and the right channel signal.

6. The electronic apparatus according to claim 1, wherein the processor is further configured to identify a size difference or a time difference between the left channel signal and the right channel signal.

7. The electronic apparatus according to claim 1, wherein the outputted audio signal comprises more channel signals than the audio signal received through the signal receiver.

8. The electronic apparatus according to claim 1, further comprising a display configured to display an image, wherein the received audio signal corresponds to an image content displayed on the display.

9. A control method of an electronic apparatus comprising:

receiving an audio signal;

separating the received audio signal into a plurality of channel signals;

identifying a gain corresponding to a phase difference between a left channel signal from among the plurality of channel signals and a right channel signal from among the plurality of channel signals;

adjusting relative ratios among a plurality of output signals for a plurality of speakers, respectively, which are obtained from the left channel signal and the right channel signal, according to the identified gain for generating an audio signal in which a sound image is varied; and outputting the generated audio signal, wherein the method further comprises identifying the phase difference between the left channel signal and the right channel signal according to a number of time sections of the received audio signal, and wherein the plurality of output signals comprise:

a first left sub channel signal and a second left sub channel signal which are obtained based on a first gain corresponding to a first phase difference between the left channel signal and the right channel signal, and a first right sub channel signal and a second right sub channel signal which are obtained based on a second gain corresponding to a second phase difference between the left channel signal and the right channel signal.

10. The method according to claim 9, wherein the adjusting comprises adjusting a relative ratio between the left channel signal and the right channel signal generated from the separated plurality of channel signals.

11. The method according to claim 9, further comprising:

converting the left channel signal and the right channel signal into frequency domains; and identifying a phase difference between the left channel signal and the right channel signal, converted into the frequency domains.

12. The method according to claim 11, wherein the identifying the phase difference comprises identifying the phase difference according to a plurality of frequency subbands for the left channel signal and the right channel signal converted into the frequency domains.

13. The method according to claim 9, further comprising identifying the phase difference based on low bandpass signals of the left channel signal and the right channel signal.

14. The method according to claim 9, further comprising identifying a size difference or a time difference between the left channel signal and the right channel signal.

15. The method according to claim 9, wherein the outputted audio signal comprises more channel signals than the received audio signal.

16. A non-transitory computer readable recording medium having stored thereon a program which, when executed, causes an electronic apparatus to perform a method comprising:

separating an input audio signal into a plurality of channel signals;

identifying a gain corresponding to a phase difference between a left channel signal from among the plurality of channel signals and a right channel signal from among the plurality of channel signals; and adjusting relative ratios among a plurality of output signals for a plurality of speakers, respectively, which are obtained from the left channel signal and the right channel signal, according to the identified gain for generating an output audio signal in which a sound image is varied, wherein the method further comprises identifying the phase difference between the left channel signal and the right channel signal according to a number of time sections of the input audio signal, and wherein the plurality of output signals comprise:

a first left sub channel signal and a second left sub channel signal which are obtained based on a first gain corresponding to a first phase difference between the left channel signal and the right channel signal, and a first right sub channel signal and a second right sub channel signal which are obtained based on a second gain corresponding to a second phase difference between the left channel signal and the right channel signal.

* * * * *